US006354077B1

(12) United States Patent
Behr et al.

(10) Patent No.: US 6,354,077 B1
(45) Date of Patent: Mar. 12, 2002

(54) METHOD AND SYSTEM FOR CONTROLLING AIR/FUEL LEVEL IN TWO-BANK EXHAUST SYSTEM

(75) Inventors: Kenneth John Behr, Farmington Hills; Brent Edward Sealy, Dearborn; Richard Andrew Booth, Canton, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/488,632

(22) Filed: Jan. 20, 2000

(51) Int. Cl.[7] ..... F01N 3/00

(52) U.S. Cl. ..... 60/274; 60/277; 60/285

(58) Field of Search ..... 60/274, 276, 277, 60/285; 123/688, 690, 691, 692

(56) References Cited

U.S. PATENT DOCUMENTS

| | | | | |
|---|---|---|---|---|
| 4,127,088 A | * | 11/1978 | Ezoe | 60/285 |
| 5,056,308 A | * | 10/1991 | Kume et al. | 60/276 |
| 5,074,113 A | | 12/1991 | Matsuoka | |
| 5,207,057 A | | 5/1993 | Kayanuma | 60/276 |
| 5,228,287 A | | 7/1993 | Kuronishi et al. | |
| 5,233,829 A | | 8/1993 | Komatsu | 60/276 |
| 5,237,818 A | * | 8/1993 | Ishii et al. | 60/274 |
| 5,247,793 A | | 9/1993 | Yamada et al. | |
| 5,255,512 A | | 10/1993 | Hamburg et al. | |
| 5,279,114 A | | 1/1994 | Kurita et al. | |
| 5,282,360 A | | 2/1994 | Hamburg et al. | 60/274 |

(List continued on next page.)

OTHER PUBLICATIONS

U.S.P.A. for "Method And System For Compensating For Degraded Pre–Catalyst Oxygen Sensor In A Two–Bank Exhaust System" filed on the same date hereof; Inventors: Booth, et al.; Attorney Docket No. 198–0963 (65080–0005).

U.S.P.A. for "Method And System For Controlling Air/Fuel Level For Internal Combustion Engine With Two Exhaust Banks" filed on the same date hereof; Inventors: Booth, et al.; Attorney Docket No. 199–1772 (65080–0007).

U.S.P.A. for "Method For Controlling Air/Fuel Mixture" filed on the same date hereof; Inventors: Booth, et al.; Attorney Docket No. 199–1803 (65080–0008).

U.S.P.A. for "Diagnostic System For Detecting Catalyst Failure Using Switch Ratio" filed on the same date hereof; Inventors: Booth, et al.; Attorney Docket No. 199–1788 (65080–0009).

U.S.P.A. for "Diagnostic System For Monitoring Catalyst Operation Using Arc Length Ratio" filed on the same date hereof; Inventors: Booth, et al.; Attorney Docket No. 199–1790 (65080–0010).

*Primary Examiner*—Thomas Denion
*Assistant Examiner*—Tu M. Nguyen
(74) *Attorney, Agent, or Firm*—John F. Buckert; Allan J. Lippa

(57) ABSTRACT

A method and system for adjusting a fuel injection amount in one of two groups of cylinders in an internal combustion engine using feedback signals generated by oxygen sensors coupled to both groups of cylinders. The claimed invention includes first and second groups of engine cylinders coupled to first and second exhaust banks respectively. The first exhaust bank includes a catalyst and at least a pre-catalyst EGO sensor for generating a first feedback signal. The second exhaust bank includes a catalyst and a post-catalyst EGO sensor for generating a second feedback signal. A controller calculates desired air/fuel ratio values for the first group of cylinders based on the first feedback signal. The controller also calculates desired air/fuel ratio values for the second group of cylinders based on the first feedback signal and the second feedback signal. The controller adjusts the level of liquid fuel injected into the groups of cylinders based on the calculated air/fuel ratio values.

15 Claims, 4 Drawing Sheets

U.S. PATENT DOCUMENTS 5,318,003 A * 6/1994 Kadota ..... 60/276
5,359,852 A 11/1994 Curran et al.
5,377,484 A 1/1995 Shimizu
5,385,016 A * 1/1995 Zimlich et al. ..... 60/274
5,394,691 A 3/1995 Seki
5,417,058 A 5/1995 Shimizu
5,450,837 A 9/1995 Uchikawa
5,485,382 A 1/1996 Seki et al. ..... 60/274
5,511,377 A 4/1996 Kotwicki
5,544,481 A * 8/1996 Davey et al. ..... 60/274
5,570,574 A 11/1996 Yamashita et al.
5,704,339 A 1/1998 Choe et al.
5,706,793 A 1/1998 Orzel et al.
5,749,221 A 5/1998 Kawahira et al.
5,894,727 A 4/1999 Zimlich
5,899,062 A 5/1999 Jerger et al.
5,927,260 A * 7/1999 Kishimoto et al. ..... 123/688
5,956,940 A * 9/1999 Manaka ..... 60/274

* cited by examiner

METHOD AND SYSTEM FOR CONTROLLING AIR/FUEL LEVEL IN TWO-BANK EXHAUST SYSTEM

TECHNICAL FIELD OF THE INVENTION

The present invention relates generally to electronic control of an internal combustion engine having first and second groups of cylinders. In particular, this invention relates to a system and method of controlling the air/fuel ratio in the second group of cylinders based on a feedback signal received from an oxygen exhaust sensor located downstream of the second group of cylinders and a feedback signal from at least one exhaust gas oxygen sensor located downstream of the first group of cylinders.

BACKGROUND

To meet current emission regulations, automotive vehicles can regulate the air/fuel ratio (A/F) supplied to the vehicles' cylinders so as to achieve maximum efficiency of the vehicles' catalysts. For this purpose, it is known to control the air/fuel ratio of internal combustion engines using an exhaust gas oxygen (EGO) sensor positioned in the exhaust stream from the engine. The EGO sensor provides feedback data to an electronic controller that calculates preferred A/F values over time to achieve optimum efficiency of a catalyst in the exhaust system. It is also known to have systems with two EGO sensors in the exhaust stream in an effort to achieve more precise A/F control with respect to the catalyst window. Normally, a pre-catalyst EGO sensor is positioned upstream of the catalyst and a post-catalyst EGO sensor is positioned downstream of the catalyst. Finally, in connection with engines having two groups of cylinders, it is known to have a two-bank exhaust system coupled thereto where each exhaust bank has a catalyst as well as pre-catalyst and post-catalyst EGO sensors. Each of the exhaust banks corresponds to a group of cylinders in the engine. The feedback signals received from the EGO sensors are used to calculate the desired A/F values in their respective group of cylinders at any given time. The controller uses these desired A/F values to control the amount of liquid fuel that is injected into the cylinders by the vehicle's fuel injector. It is a known methodology to use the EGO sensor feedback signals to calculate desired A/F values that collectively, when viewed against time, form A/F waveforms having ramp portions, jumpback portions and hold portions, as shown in FIG. 4.

Sometimes, in a two-bank, four-EGO sensor exhaust system, one of the pre-catalyst EGO sensors degrades. In other circumstances, it is desirable to purposely eliminate one of the pre-catalyst EGO sensors in a two-bank system to reduce the cost of the system. In either event, it is desirable to be able to control the A/F in the group of cylinders coupled to the exhaust bank having only one operational EGO sensor by using the feedback signals received from the three operational EGO sensors alone. It is a known methodology to compensate for a degraded or missing pre-catalyst EGO sensor in one of the exhaust banks by having the A/F values in the corresponding group of cylinders mirror the A/F values in the other group of cylinders. Essentially, this known methodology simply calculates desired A/F values over time for the group of cylinders coupled to two properly functioning EGO sensors and uses those A/F values for both banks. But this methodology fails to utilize the feedback signal provided by the post-catalyst EGO sensor in the exhaust bank having the degraded or missing pre-catalyst EGO sensor. Therefore, the A/F values applied to the group of cylinders coupled to the degraded or missing pre-catalyst EGO sensor do not benefit from any feedback signal specific to that bank, and, as a result, the A/F values used in that group of cylinders may not be optimal to enable the corresponding catalyst to perform most efficiently.

Finally, in certain applications it is desirable for the A/F waveform created by the calculated A/F values of one of the banks to be inverted relative to the A/F waveform of the other bank. The inversion of the A/F waveform in one of the banks relative to the A/F waveform in the other bank improves operation of the system in certain cases, such as when the engine is in idle mode.

Therefore, it is desirable to have an improved methodology and system for calculating A/F values for a group of cylinders coupled to an exhaust bank having a degraded or missing pre-catalyst EGO sensor. The improved methodology and system should utilize the feedback signal received from the post-catalyst EGO sensor in the exhaust bank having the degraded or missing pre-catalyst EGO sensor to calculate more responsive A/F values and thus enable the catalyst to operate more efficiently.

SUMMARY OF THE INVENTION

The present invention is directed toward a new methodology and system for controlling the A/F level in one of two groups of cylinders in an internal combustion engine by using a feedback signal from an EGO sensor coupled downstream of that group of cylinders and a feedback signal from at least one EGO sensor coupled downstream of the other group of cylinders. In an engine having two groups of cylinders coupled to a two-bank exhaust system, the present invention calculates preferred A/F values for the second group of cylinders based on feedback signals received from a pre-catalyst EGO sensor and a post-catalyst EGO sensor coupled to the first group of cylinders and a feedback signal received from a post-catalyst EGO sensor coupled to the second group of cylinders. The present invention is particularly applicable to well-known two-bank four EGO sensor exhaust systems where one of the pre-catalyst EGO sensors degrades or is purposefully omitted from the system.

Specifically, a controller in the present invention uses well-known methodologies to generate preferred A/F values for the group of cylinders coupled to two functioning EGO sensors (the "First Bank"). The controller, in cooperation with a fuel injector, uses those A/F values to control the amount of liquid fuel that is injected into those cylinders, according to well-known methods. The preferred A/F values form an A/F waveform over time, which includes ramp portions, jumpback portions and hold portions, as is known in the art. This invention can also be used in connection with a variety of different A/F waveforms. The controller uses a feedback signal provided by the post-catalyst EGO sensor of the exhaust bank coupled to one operational EGO sensor (the "Second Bank") to modify the A/F values calculated for the First Bank, thereby generating A/F values for the Second Bank. According to one preferred embodiment of this invention, the A/F values for the Second Bank are calculated by adding a certain offset value to the corresponding A/F values of the First Bank. The offset value for each A/F value of the Second Bank is calculated based on the feedback signal from the post-catalyst EGO sensor in the Second Bank.

In a second embodiment of this invention, the controller generates an A/F waveform for the Second Bank that is inverted relative to the A/F waveform for the First Bank.

First, A/F values for the Second Bank are calculated by adding a certain offset value to the corresponding First Bank A/F values, as described above. Again, the offset value is determined based on the feedback signal received from the post-catalyst EGO sensor in the Second Bank. Then, the controller calculates a centroid value of the First Bank A/F waveform. Finally, the controller inverts the A/F values of the First Bank waveform about the centroid to generate an A/F waveform for the group of cylinders coupled to the Second Bank. As a result, the A/F waveform for the group of cylinders coupled to the Second Bank is inverted around the centroid relative to the A/F waveform for the group of cylinders coupled to the First Bank.

The disclosed methods and systems provide more responsive A/F values, and, as a result, permit the catalyst in the One-Sensor Bank to operate more efficiently compared to the known method of mirroring the A/F values in the two banks without using any feedback from the post-catalyst sensor in the One-Sensor bank.

DETAILED DESCRIPTION OF THE PREFERRED EMBODIMENT

Figure 1:
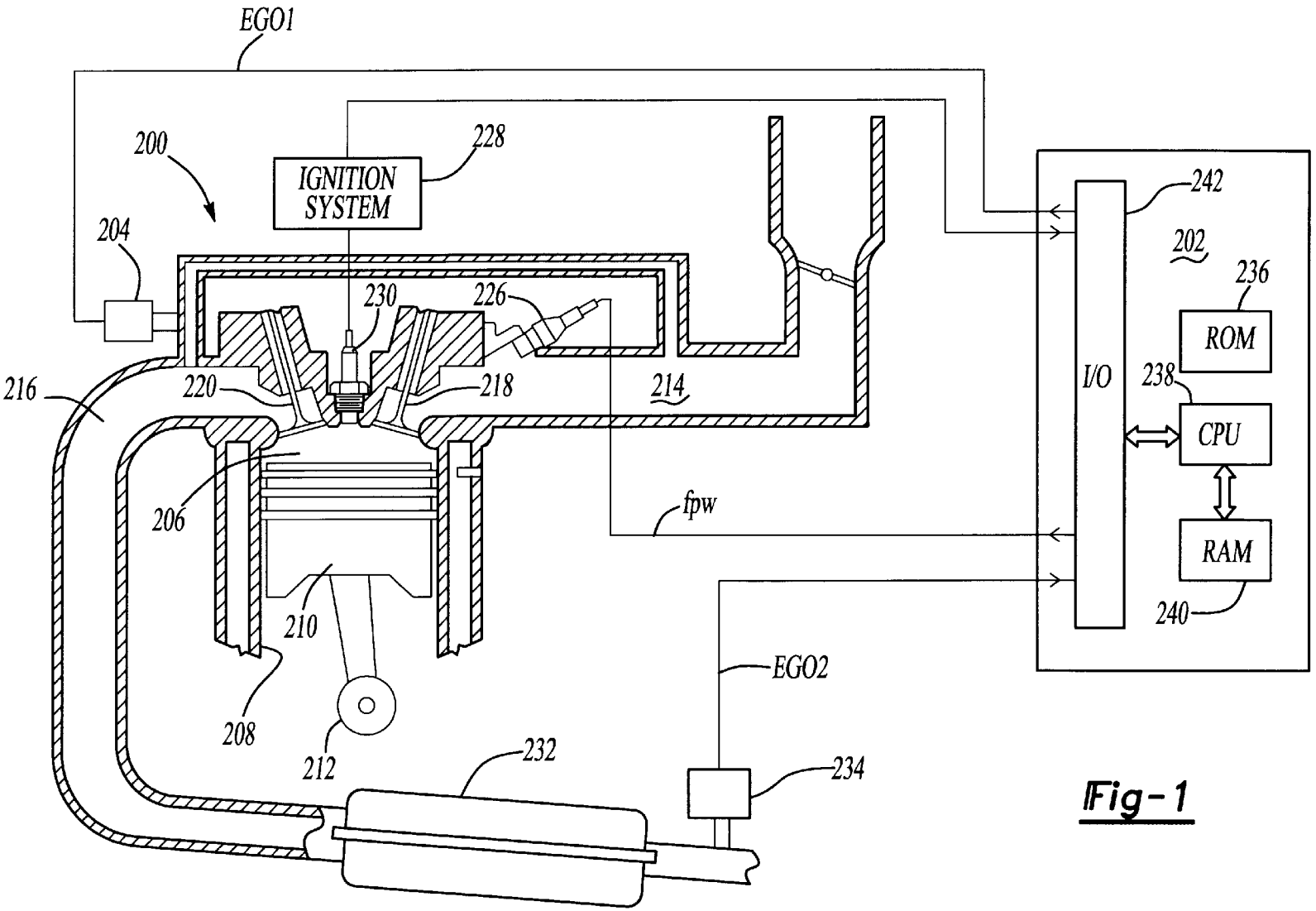
FIG. 1 illustrates an internal combustion engine, according to a preferred embodiment of the invention.

FIG. 1 illustrates an internal combustion engine. Engine 200 generally comprises a plurality of cylinders, but, for illustration purposes, only one cylinder is shown in FIG. 1. Engine 200 includes combustion chamber 206 and cylinder walls 208 with piston 210 positioned therein and connected to crankshaft 212. Combustion chamber 206 is shown communicating with intake manifold 214 and exhaust manifold 216 via respective intake valve 218 and exhaust valve 220. As described later herein, engine 200 may include multiple exhaust manifolds with each exhaust manifold corresponding to a group of engine cylinders. Intake manifold 214 is also shown having fuel injector 226 coupled thereto for delivering liquid fuel in proportion to the pulse width of signal FPW from controller 202. Fuel is delivered to fuel injector 226 by a conventional fuel system (not shown) including a fuel tank, fuel pump, and fuel rail (not shown).

Conventional distributorless ignition system 228 provides ignition spark to combustion chamber 206 via spark plug 230 in response to controller 202. Two-state EGO sensor 204 is shown coupled to exhaust manifold 216 upstream of catalyst 232. Two-state EGO sensor 234 is shown coupled to exhaust manifold 216 downstream of catalyst 232. EGO sensor 204 provides a feedback signal EGO1 to controller 202 which converts signal EGO1 into two-state signal EGOS1. A high voltage state of signal EGOS1 indicates exhaust gases are rich of a reference A/F and a low voltage state of converted signal EGO1 indicates exhaust gases are lean of the reference A/F. EGO sensor 234 provides signal EGO2 to controller 202 which converts signal EGO2 into two-state signal EGOS2. A high voltage state of signal EGOS2 indicates exhaust gases are rich of a reference air/fuel ratio and a low voltage state of converted signal EGO1 indicates exhaust gases are lean of the reference A/F. Controller 202 is shown in FIG. 1 as a conventional microcomputer including: microprocessor unit 238, input/output ports 242, read only memory 236, random access memory 240, and a conventional data bus.

Figure 2:
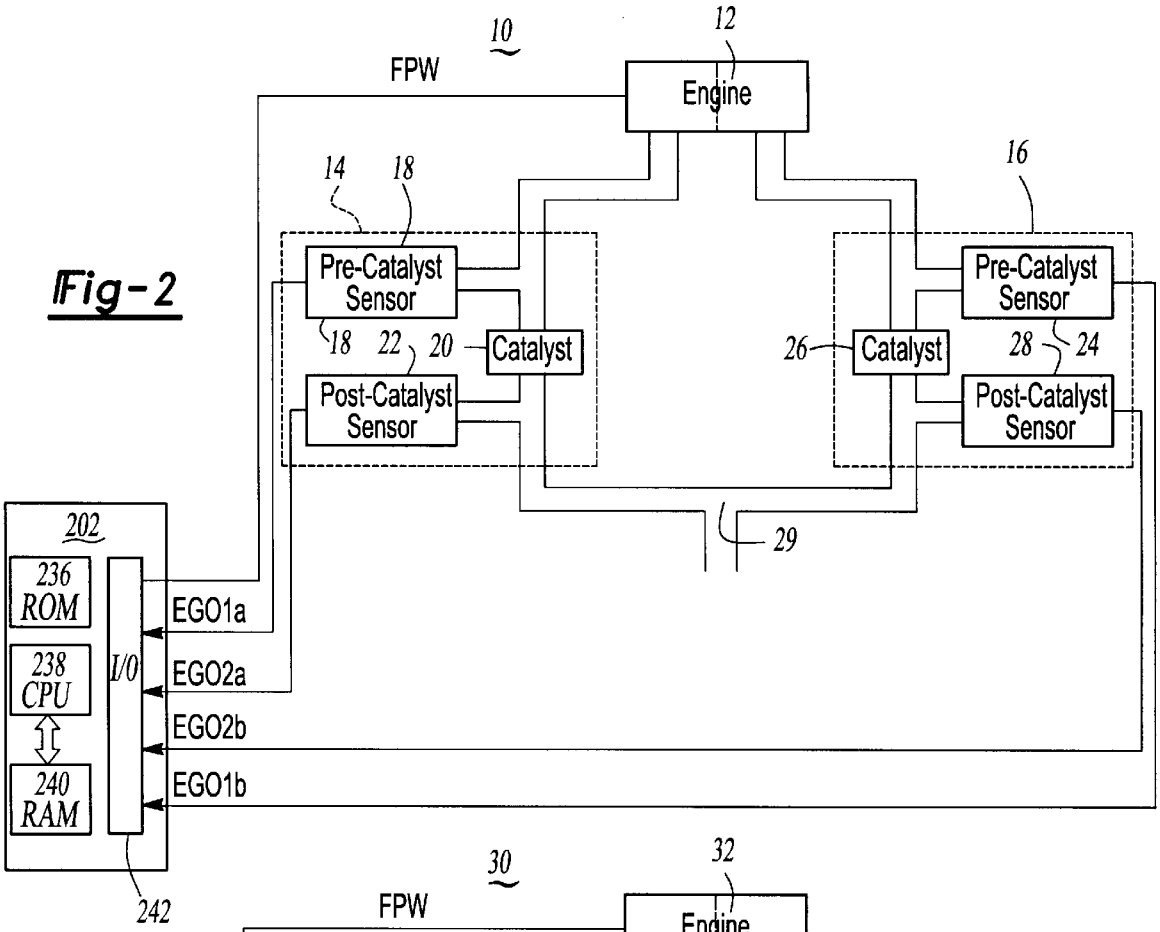
FIG. 2 shows a schematic representation of a well-known two-bank exhaust system with each bank having pre-catalyst and post-catalyst EGO sensors.
Figure 3:
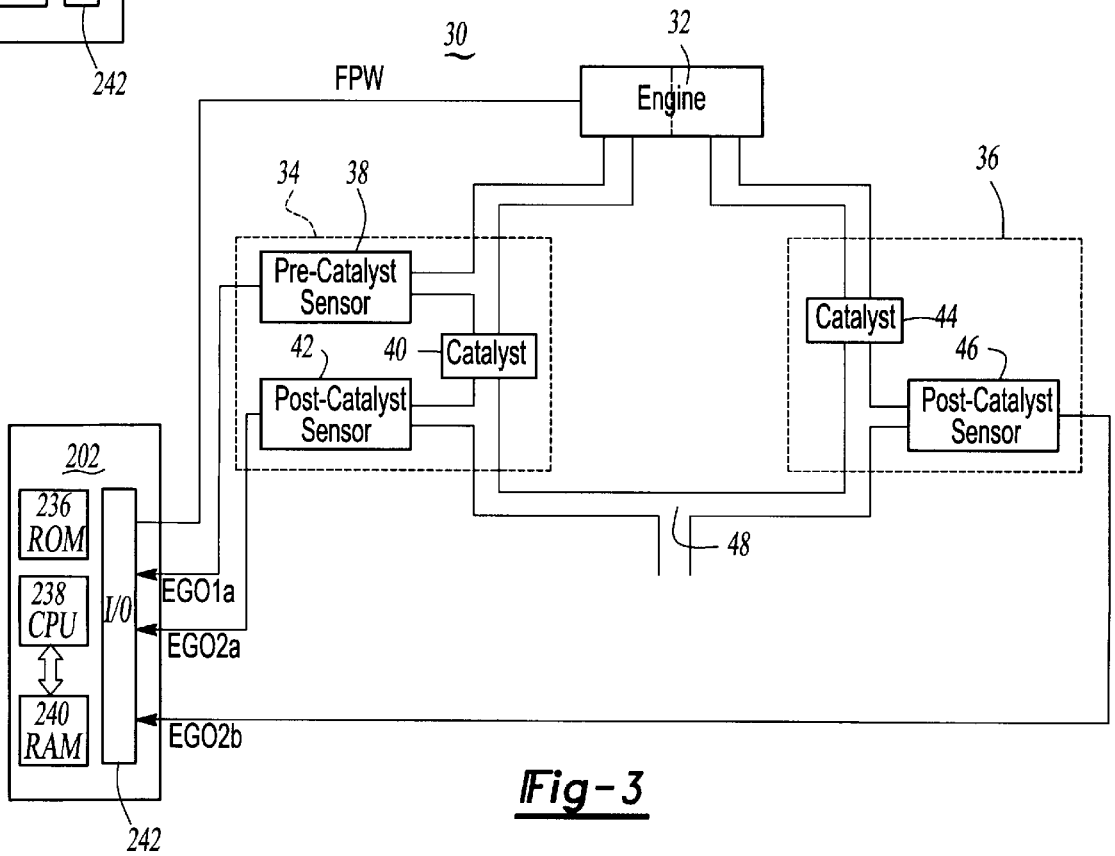
FIG. 3 shows a schematic representation of a two-bank exhaust system wherein one bank has a pre-catalyst and a post-catalyst EGO sensor and the other bank only has a post-catalyst EGO sensor.

FIGS. 2 and 3 schematically illustrate preferred embodiments of a two-bank exhaust system of the present invention. FIG. 2 shows a well-known two-bank, four-EGO-sensor exhaust system. As illustrated in FIG. 2, exhaust gases flow from first and second groups of cylinders of engine 12 through a corresponding first exhaust bank 14 and second exhaust bank 16. Engine 12 is the same as or similar to engine 200 in FIG. 1. Exhaust bank 14 includes pre-catalyst EGO sensor 18, catalyst 20, and post-catalyst EGO sensor 22. Exhaust bank 16 includes pre-catalyst EGO sensor 24, catalyst 26 and post-catalyst EGO sensor 28. The pre-catalyst EGO sensors, catalysts, and post-catalyst EGO sensors in FIG. 2 are the same as or similar to pre-catalyst EGO sensor 204, catalyst 232, and post-catalyst EGO sensor 234 in FIG. 1.

In operation, when exhaust gases flow from engine 12 through exhaust bank 14, pre-catalyst EGO sensor 18 senses the level of oxygen in the exhaust gases passing through bank 14 prior to them entering catalyst 20 and provides feedback signal EGO1*a* to controller 202. After the exhaust gases pass through catalyst 20, post-catalyst EGO sensor 22 senses the level of oxygen in the exhaust gases subsequent to exiting catalyst 20 and provides feedback signal EGO1*b* to controller 202. With respect to exhaust bank 16, pre-catalyst EGO sensor 24 senses the level of oxygen in the exhaust gases passing through bank 16 prior to them entering catalyst 26 and provides feedback signal EGO2*a* to controller 202. After the exhaust gases pass through catalyst 26, post-catalyst EGO sensor 28 senses the level of oxygen in the exhaust gases subsequent to exiting catalyst 26 and provides feedback signal EGO2*b* to controller 202. Then the exhaust gases are joined at junction 29 before being expelled from the system 10, though the disclosed invention is equally applicable to a system wherein the exhaust banks are maintained separate throughout the entire system. Controller 202 uses feedback signals EGO1*a*, EGO1*b*, EGO2*a*, and EGO2*b* to calculate preferred A/F values and uses these values to control the amount of liquid fuel that is introduced into the groups of cylinders. The controller shown in FIG. 2 is the same as or similar to controller 202 shown in FIG. 1.

FIG. 3 illustrates a two-bank exhaust system similar to that shown in FIG. 2, except that the pre-catalyst EGO sensor in one of the exhaust banks is missing. Specifically, FIG. 3 illustrates that exhaust gases expelled from engine 32 pass through exhaust banks 34 and 36. In bank 34, the oxygen content of the exhaust gases is sensed by pre-catalyst EGO sensor 38 before entering catalyst 40, and feedback signal EGO1*a* is provided to controller 202. After the exhaust gases exit catalyst 40, the oxygen content is sensed by post-catalyst EGO sensor 42, and feedback signal EGO1*b* is provided to controller 202. With respect to exhaust bank 36, the exhaust gases expelled by engine 32 enter catalyst 44. After the exhaust gases exit catalyst 44, their oxygen content is sensed by post-catalyst EGO sensor 46, and feedback signal EGO2*b* is provided to controller 202. Then the exhaust gases are joined at junction 48 before being expelled from the system 30, though the disclosed invention is equally applicable to a system wherein the exhaust banks are maintained separate throughout the entire system. As before, Controller 202 uses feedback signals EGO1*a*, EGO1*b*, EGO2*a*, and EGO2*b* to calculate preferred A/F values and uses these values to control the amount of liquid fuel that is introduced into the groups of cylinders.

The present invention is described hereinafter in terms of a two-bank three-EGO sensor system, as shown in FIG. 3. However, it is contemplated and should be understood that this invention can also be used in connection with a well-known two-bank four-EGO sensor system, as shown in FIG. 2, for purposes of compensating for a degraded post-catalyst EGO sensor in one of the banks. In such a system, well-known methodologies are used to control the desired A/F for the respective groups of cylinders while all four EGO sensors are operating properly. In the event that one of the pre-catalyst EGO sensors degrades, and such degradation is detected by the system, the disclosed and claimed invention is used to compensate for the degraded EGO sensor in the manner described hereinafter for two-bank, three-ego EGO sensor systems.

It should also be recognized that the present invention can be used in connection with a two-bank exhaust system similar to those shown in FIGS. 2 and 3, but where the banks 14 and 34 only have a pre-catalyst EGO sensor 18 and 38. That is, the present invention is applicable to two-bank exhaust systems that have at a minimum (i) a first exhaust bank having a catalyst and a pre-catalyst EGO sensor, and (ii) a second exhaust bank having a catalyst and a post-catalyst EGO sensor. In such systems, well-known methodologies are used to control the A/F levels in the first group of cylinders based on a feedback signal from only a single pre-catalyst EGO sensor. Then, A/F values for the second group of cylinders are calculated by modifying the A/F values for the first group of cylinders based on a feedback signal from the post-catalyst EGO sensor in the second bank, according to the present invention.

Figure 4:
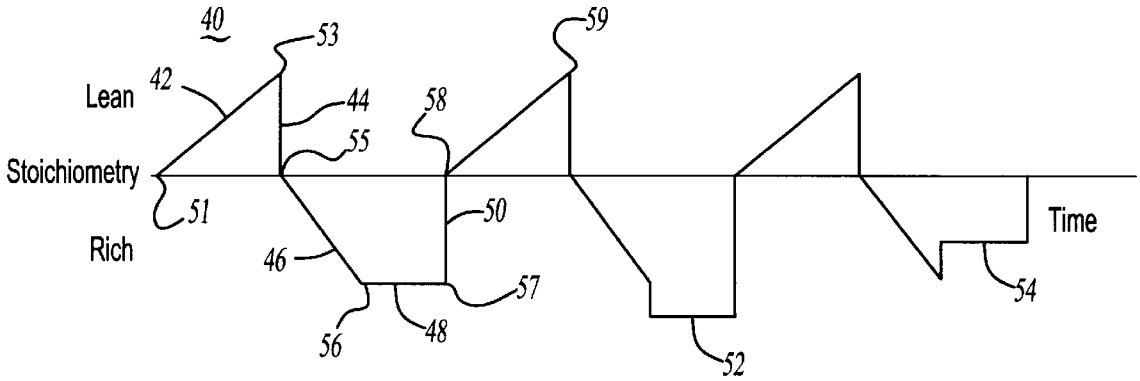
FIG. 4 shows a preferred A/F waveform for a group of cylinders calculated according to well-known techniques using feedback signals from both a pre-catalyst EGO sensor and a post-catalyst EGO sensor.

Generally, to achieve the most efficient operation of the catalysts, it is desirable to oscillate the A/F in a group of cylinders around stoichiometry so that the A/F is sometimes rich and sometimes lean relative to stoichiometry. As is well-known in the art, the A/F in a group of cylinders can be controlled by varying the rich and lean A/F levels and the amount of time during which those rich and lean levels are held. FIG. 4 illustrates a typical preferred A/F waveform 40 over time that shows A/F levels being held at rich and lean levels for certain lengths of time to control the A/F level in a group of engine cylinders. This A/F waveform 40 represents the desired A/F waveform used to control the A/F level in the group of cylinders corresponding to exhaust bank 34 of FIG. 3. Methodologies for determining such a waveform based on the feedback signals from pre-catalyst and post-catalyst EGO sensors are well-known in the art and are described in more detail in U.S. Pat. Nos. 5,282,360 and 5,255,512, for example. While the A/F waveform 40 shown in FIG. 3 is a preferred A/F waveform for exhaust bank 34, the disclosed invention also is applicable to other A/F waveforms that may be used, including an A/F waveform similar to that illustrated in FIG. 40 except inverted about the stoichiometry level.

As can be seen from the preferred A/F waveform in FIG. 4, the desired A/F level steadily rises over time, becoming more and more lean, until the EGO sensors detect a lean A/F state in the exhaust. This portion of the A/F waveform is referred to as a ramp portion 42 because the A/F level is being ramped up during this time period. After the EGO sensors detect that the A/F has reached a particular lean threshold value, the A/F is abruptly dropped toward or past stoichiometry. In the preferred embodiments of the invention, the A/F is dropped to a level approximately equal to stoichiometry, as shown at point 55 in FIG. 4. This portion of the waveform is referred to as a jumpback portion 44 because of the abrupt return of the A/F toward stoichiometry. Then, the A/F steadily decreases, becoming more and more rich, until the A/F reaches a particular rich threshold value. Similar to when the A/F steadily increases, this portion of the waveform is referred to as a ramp portion 46. Finally, after the EGO sensors detect that the A/F has decreased to a rich A/F state, the A/F is jumped to and held at a particular A/F level that delivers a desired level of rich bias. This portion of the A/F waveform is referred to as a hold portion 48. After the hold portion, the A/F level jumps back 50 toward stoichiometry, and the process is repeated. The A/F waveform 40 depicted in FIG. 4 is typical of a preferred waveform for a group of cylinders coupled to an exhaust bank having two EGO sensors, like bank 34 of FIG. 3. As is illustrated at points 52 and 54 of FIG. 4 the A/F hold portions 48, 52, 54 of waveform 40 may vary from time to time based upon feedback signal EGO2*a* received from post-catalyst EGO sensor 42. Controller 202 calculates the desired A/F ramp slope, the jumpback values, and the hold values based on feedback signals EGO1*a* and EGO1*b* received from EGO sensors 38 and 42, respectively.

Figure 5:
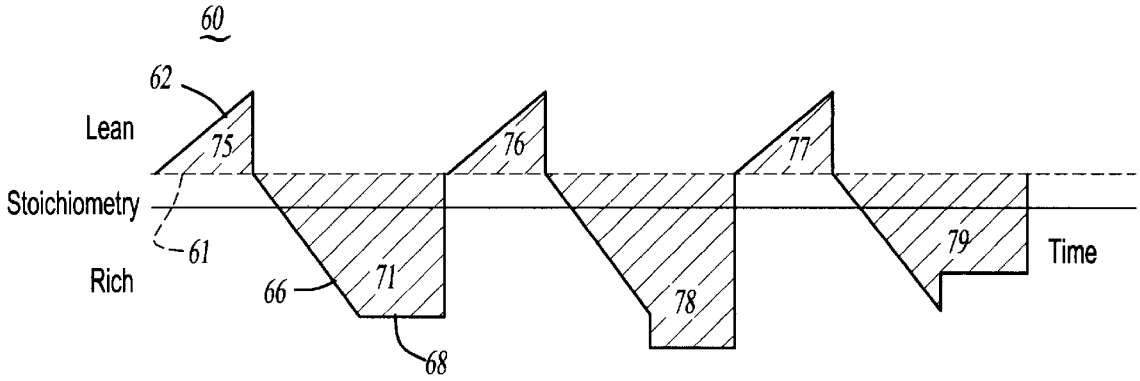
FIG. 5 shows an A/F waveform for an exhaust bank having a degraded or missing pre-catalyst EGO sensor, according to a first preferred embodiment of the present invention.

Turning to exhaust bank 36 in FIG. 3, known methodologies for calculating preferred A/F values for the group of cylinders coupled to exhaust bank 36 are not applicable because they depend upon receiving feedback signals from both a pre-catalyst and a post-catalyst EGO sensor or at least a pre-catalyst EGO sensor. Thus, according to a first preferred embodiment of the present invention, preferred A/F values for the group of cylinders coupled to exhaust bank 36 are calculated by using the A/F waveform 40 calculated for bank 34 (using well-known methodologies) and modifying it according to feedback signal EGO2*b* received from post-catalyst EGO sensor 46. In particular, the A/F values that constitute waveform 60 corresponding to bank 36 are the same as those that form A/F waveform 40 shown in FIG. 4, except that each of the A/F values 60 is offset either toward the lean side of stoichiometry (as shown in FIG. 5) or toward the rich side of stoichiometry (not shown) depending upon feedback signal EGO2*b* received from post-catalyst EGO sensor 46. If the post-catalyst EGO sensor 46 detects a lean state, then A/F values 60 are offset toward the rich side of stoichiometry. If, on the other hand, the post-catalyst EGO sensor 46 detects a rich state, then A/F values 60 are offset toward the lean side of stoichiometry, as shown in FIG. 4. Except for adding an offset value to the entire A/F waveform 40, the A/F values for the A/F waveform 60, as used in bank 36, correspond directly to the A/F values that constitute A/F waveform 40, as used in bank 34. Specifically, ramp portion 62 is derived by adding offset value 61 to ramp portion 42. Similarly, hold portion 68 is derived by adding offset value 61 to hold portion 48. The remaining portions of waveform 60 are calculated similarly.

Figure 6:
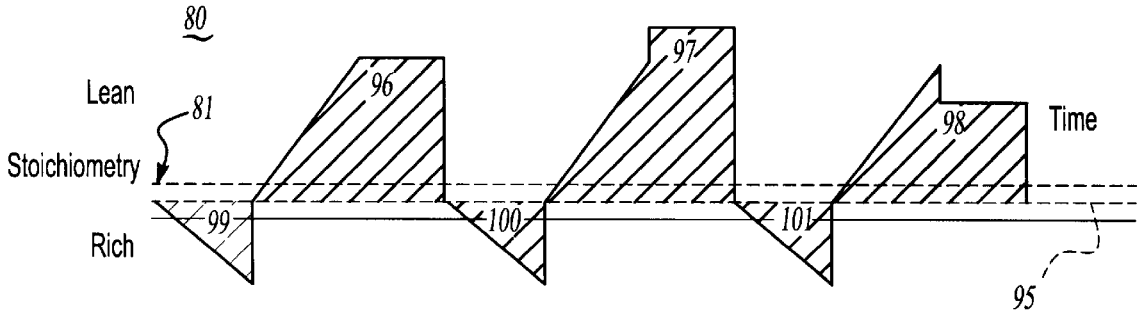
FIG. 6 shows an A/F waveform for an exhaust bank having a degraded or missing pre-catalyst EGO sensor, according to a second preferred embodiment of the present invention.

FIG. 6 illustrates an alternative preferred A/F waveform for controlling the A/F level in the group of cylinders coupled to exhaust bank 36, according to a second preferred embodiment of the invention. Sometimes, it is desirable for the A/F values in one of the groups of cylinders to be inverted relative to the A/F values in the other bank. At least one situation when it is desirable to utilize inverted A/F waveforms is when the engine is in an idle mode. FIG. 6 illustrates an inverted A/F waveform 80.

When it is desirable for bank 36 to utilize an inverted A/F waveform 80, the A/F waveform 80 is derived by copying the A/F values that constitute waveform 40, as used in bank 34, and offsetting each of those values 40, as described hereinabove in connection with the first preferred embodiment of the invention, to generate an A/F waveform similar to A/F waveform 60 in FIG. 5. Then, the offset waveform 60 is inverted. However, in order to maintain optimum efficiency of the catalyst 44, it is important that the total overall bias of the system not change as a result of the A/F waveform being inverted. Specifically, the A/F bias levels above and below the offset value 81 for A/F waveform 80 should equal the corresponding bias levels above and below the offset value 61 in A/F waveform 60. That is, the sum of the areas 75, 76 and 77 in waveform 60 should equal the sum of the areas 99, 100 and 101. Similarly, the sum of the areas 71, 78, and 79 should equal the sum of the areas 99, 100, and 101. A simple inversion of A/F waveform 60 about stoichiometry would not accomplish this objective.

Generally speaking, to maintain the same bias level of the system before and after the A/F waveform is inverted, a centroid level 95 is calculated. The centroid level 95 is then used to calculate A/F values 80 such that A/F values 80 oscillate around centroid level 95. Oscillating the A/F values 80 about the centroid level 95 maintains bias levels above and below the offset value 81 in FIG. 6 equal to the corresponding bias levels above and below the offset value 61 in FIG. 5.

Figure 7:
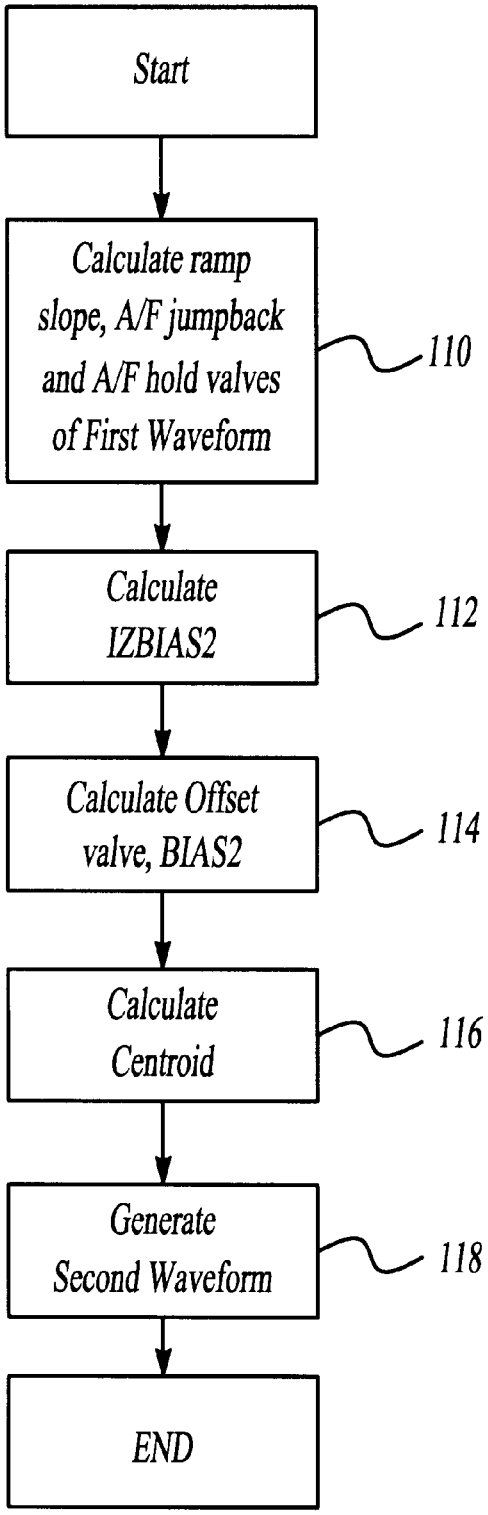
FIG. 7 is a flow-chart of the methodology used to calculate a waveform for an exhaust bank having only a post-catalyst EGO sensor that is operational.

The specific methodology for generating the A/F values that constitute waveform 80 is illustrated in FIG. 7 and described as follows. First, the slope of the ramp portion 42, the A/F jumpback value 44, and the A/F hold value 48 of waveform 40 used in bank 34 are calculated, as shown at step 110. These values are calculated according to well-known methodologies. Next, a feedback bias value for bank 36, referred to as RBIAS2, is calculated based on feedback signal EG02*b* provided by post-catalyst EGO sensor 46, as shown in step 112. In a preferred embodiment of the invention, RBIAS2 is a sum of a proportional feedback bias term and an integral feedback bias term, as is known in the art.

After RBIAS2 is calculated, it is used to calculate the offset value 61, 81, referred to as BIAS2, for the new A/F waveform, as shown in Step 114. BIAS2 is calculated by adding RBIAS2 to a state-of-the-system bias value. The state-of-the-system bias value is determined as a function of engine speed and engine load, as is known in the art.

Next, as illustrated in step 116, the centroid of A/F waveform 40 is calculated based on certain A/F values from waveform 40. The details of that calculation are now described hereafter. Referring to FIG. 4, each point on waveform 40 is defined by two values: (i) an A/F level value and (ii) a time value. For example, waveform point 51 is a lean jumpback point defined by the particular A/F value on waveform 40 at point 51 and by the time value (measured along the "time" axis) at point 51. Similarly, waveform point 53 is defined by the A/F value on waveform 40 at point 53 and by the time value at point 53. For purposes of describing a preferred embodiment of the invention, waveform points 51, 53, 55, 56, 57, 58, and 59 are described as follows:

| Waveform Point | Variable Reference | Description |
|---|---|---|
| 51 | (p1, t1) | lean jumpback |
| 53 | (p2, t1) | lean peak |
| 55 | (p3, t3) | rich jurnpback |
| 56 | (p4, t4) | rich peak |
| 57 | (p5, t5) | hold event |
| 58 | (p6, t6) | lean jumpback |
| 59 | (p7, t7) | lean peak |

where p1–p7 are the A/F values of waveform 40 at the corresponding waveform points, and where t1–t4 and t6–t7 are the time values at the corresponding waveform points, and where t5 is the length of the hold event 48. With the above-described definitions in place, the centroid of waveform 40 is calculated as follows:

$$\text{centroid}=\{[(t2-t1)*((p1+p2)/2)]+((t4-t3)*((p3+p4)/2)]+[p5*(t5-t4)]\}/(t5-t1)$$

Lastly, as illustrated in step 118, A/F values are calculated which make up waveform 80 using the calculated centroid, the value of BIAS2, and the A/F values of A/F waveform 40, as used in bank 34. Specifically, the A/F waveform 80 used in bank 36 is generated according to the following formula:

$$\text{lambse}\mathbf{2}=2*\text{Centroid}+\text{BIAS}\mathbf{2}-\text{lambse}\mathbf{1}$$

where lambse2 represents the A/F values that constitute waveform 80 and lambse1 represents the corresponding A/F values of waveform 40. The calculations described above and the determination of the set of A/F values 40, 60, and 80 are accomplished by controller 202. Controller 202 uses the calculated A/F values to control the A/F in the engine via signal FPW to fuel injector 226, as shown in FIG. 1 and as is well-known in the art.

While preferred embodiments of the present invention have been described herein, it is apparent that the basic construction can be altered to provide other embodiments which utilize the processes and compositions of this invention. Therefore, it will be appreciated that the scope of this invention is to be defined by the claims appended hereto rather than by the specific embodiments which have been presented hereinbefore by way of example.

What is claimed is:

1. A method for controlling fuel injection in an engine having a first group of cylinders and a second group of cylinders coupled to a first catalyst and a second catalyst respectively, the method comprising:

generating a first feedback signal from a first EGO sensor located upstream of the first catalyst;

generating a second feedback signal from a second EGO sensor located downstream of the second catalyst, said second EGO sensor monitoring exhaust passing only through the second catalyst;

calculating an A/F value for the first group of cylinders based on said first feedback signal; and adjusting a fuel injection amount into the second group of cylinders based on said A/F value for the first group of cylinders and said second feedback signal.

2. The method of claim 1, further comprising the step of generating a third feedback signal from a third EGO sensor located downstream of the first catalyst.

3. The method of claim 1, wherein said step of adjusting a fuel injection amount into the second group of cylinders comprises the step of calculating an A/F value for the second group of cylinders.

4. The method of claim 3, wherein said step of calculating an A/F value for the second group of cylinders further comprises the step of substantially inverting said A/F value for the first group of cylinders around stoichiometry.

5. The method of claim 4, wherein said step of calculating an A/F value for the second group of cylinders further comprises the steps:

calculating a first bank A/F waveform for the first group of cylinders based on said first feedback signal;

calculating a centroid value of said first bank A/F waveform; and calculating said A/F value for the second group of cylinders based on said centroid value.

6. The method of claim 5, wherein said step of generating a first bank A/F waveform comprises the sub-steps:

generating a first A/F ramp slope corresponding to the first group of cylinders;

generating a first A/F jumpback value corresponding to the first group of cylinders; and generating a first A/F hold value corresponding to the first group of cylinders.

7. The method of claim 1, further comprising the step of detecting a degraded EGO sensor located upstream of the second catalyst.

8. The method of claim 7, wherein said step of adjusting a fuel injection amount into the second group of cylinders comprises the step of calculating an A/F value for the second group of cylinders.

9. The method of claim 8, wherein said step of calculating an A/F value for the second group of cylinders further comprises the step of substantially inverting said A/F value for the first group of cylinders relative to stoichiometry.

10. The method of claim 9, wherein said step of calculating an A/F value for the second group of cylinders further comprises the steps:

calculating a first bank A/F waveform for the first group of cylinders based on said first feedback signal;

calculating a centroid value of said first bank A/F waveform; and calculating said A/F value for the second group of cylinders based on said centroid value.

11. The method of claim 10, wherein said step of generating a first bank A/F waveform comprises the sub-steps:

generating a first A/F ramp slope corresponding to the first group of cylinders;

generating a first A/F jumpback value corresponding to the first group of cylinders; and generating a first A/F hold value corresponding to the first group of cylinders.

12. An A/F level control system for an internal combustion engine having first and second groups of cylinders coupled to first and second catalysts, respectively, comprising:

a first EGO sensor located upstream of the first catalyst for generating a first feedback signal;

a second EGO sensor located downstream of the second catalyst and that monitors exhaust passing primarily through the second catalyst at a position where exhaust from said second catalyst is not mixed with said exhaust from said first catalyst, said second oxygen sensor generating a second feedback signal; and a controller coupled to said first and second EGO sensors for generating an A/F value for the first group of cylinders based on said first feedback signal and for adjusting a fuel injection amount into the second group of cylinders by offsetting said A/F value for the first group of cylinders by an offset value calculated based on said second feedback signal.

13. The A/F level control system of claim 12, further comprising a third EGO sensor located downstream of the first catalyst for generating a third feedback signal to said controller.

14. A method for controlling fuel injection in an engine having a first group of cylinders and a second group of cylinders coupled to a first catalyst and a second catalyst respectively, the method comprising:

generating a first feedback signal from a first exhaust sensor located upstream of the first catalyst;

generating a second feedback signal from a second exhaust sensor located downstream of the second catalyst and that monitors exhaust passing primarily through the second catalyst at a position where exhaust from said second catalyst is not mixed with exhaust from said first catalyst;

calculating an A/F value for the first group of cylinders based on said first feedback signal; and adjusting a fuel injection amount into the second group of cylinders based on said A/F value for the first group of cylinders and said second feedback signal.

15. An A/F level control system for an internal combustion engine having first and second groups of cylinders coupled to first and second catalysts, respectively, comprising:

a first exhaust sensor located upstream of the first catalyst for generating a first feedback signal;

a second exhaust sensor located downstream of the second catalyst and that monitors exhaust passing primarily through the second catalyst at a position where exhaust from said second catalyst is not mixed with exhaust from said first catalyst, said second oxygen sensor generating a second feedback signal; and a controller coupled to said first and second exhaust sensors for generating an A/F value for the first group of cylinders based on said first feedback signal and for adjusting a fuel injection amount into the second group of cylinders by offsetting said A/F value for the first group of cylinders by an offset value calculated based on said second feedback signal.

* * * * *